US009233380B2

(12) United States Patent
Huang et al.

(10) Patent No.: US 9,233,380 B2
(45) Date of Patent: Jan. 12, 2016

(54) REVOLVINGLY SPRAYING DEVICE

(75) Inventors: Su Yen Huang, New Taipei (TW); Tzu An Hsu, New Taipei (TW)

(73) Assignee: STRONG FORTRESS TOOL CO., LTD., New Taipei (TW)

( * ) Notice: Subject to any disclaimer, the term of this patent is extended or adjusted under 35 U.S.C. 154(b) by 225 days.

(21) Appl. No.: 13/606,195

(22) Filed: Sep. 7, 2012

(65) Prior Publication Data

US 2014/0042249 A1 Feb. 13, 2014

(30) Foreign Application Priority Data

Aug. 10, 2012 (TW) ..... 101129011 A

(51) Int. Cl.
*B05B 1/34* (2006.01)
*B05B 3/06* (2006.01)
*B05B 7/24* (2006.01)

(52) U.S. Cl.
CPC ..... *B05B 3/06* (2013.01); *B05B 7/2435* (2013.01)

(58) Field of Classification Search
CPC .... B08B 9/0936; B05B 3/0445; B05B 3/066; B05B 3/0409
USPC ..... 239/227, 228, 223.13, 251, 222.13, 463
See application file for complete search history.

(56) References Cited

U.S. PATENT DOCUMENTS 8,056,830 B1 * 11/2011 Pedersen ..... B05B 3/028 239/222.13
2006/0065760 A1 * 3/2006 Micheli ..... B05B 3/1014 239/237
2009/0057443 A1 * 3/2009 Sendo ..... B05B 3/022 239/405
2010/0320289 A1 * 12/2010 Kuo ..... B05B 3/022 239/290
2012/0286065 A1 * 11/2012 Lin ..... B05B 3/0409 239/225.1
2013/0056558 A1 * 3/2013 Chen ..... B05B 3/028 239/302

FOREIGN PATENT DOCUMENTS

DE 2011105869 * 10/2011 ..... B05B 9/01

OTHER PUBLICATIONS

DE2011105869 English translation.*

* cited by examiner

*Primary Examiner* — Len Tran
*Assistant Examiner* — Joel Zhou
(74) *Attorney, Agent, or Firm* — Cheng-Ju Chiang

(57) ABSTRACT

A revolvingly spraying device includes a sheath tube and a revolvingly spraying tube. The revolvingly spraying tube includes a transmitting tube and a curved tube connected with the transmitting tube. The transmitting tube is inserted within the sheath tube. A front bearing is provided in one end, near the curved tube, of the transmitting tube, and a rear bearing is provided in the other end of the transmitting tube. The revolvingly spraying tube has a front position limiting portion radially protruding therefrom to retain the front side of the front bearing, and a rear position limiting portion radially protruding therefrom to retain the rear side of the rear bearing. Thus, the revolvingly spraying device has fewer component parts and is convenient for assembly.

11 Claims, 5 Drawing Sheets

REVOLVINGLY SPRAYING DEVICE

FIELD OF THE INVENTION

The present invention relates to a spraying gun, and more particularly to a revolvingly spraying device for revolvingly spraying fluid.

BACKGROUND OF THE INVENTION

There are many conventional spraying guns used widely for cleaning dust and dirt from a surface of an object, for watering, for spraying paint, and the like. The spraying guns remove dust and dirt by spraying a high pressure fluid, and perform watering and spraying paint with the use of a high pressure fluid mixed with water or other spraying liquid.

In order to uniform the distribution of the spraying, a spraying tube of the spraying gun is usually bended curve and is assembled with a rotary means, so that a mixed fluid of a high pressured gas and a spraying liquid can be sprayed out in every direction while rotating the spraying tube.

SUMMARY OF THE INVENTION

However, a large number of component parts are required in a conventional spraying gun for achieving the above revolving function when spraying fluid. It not only makes difficult in assembling of the spraying gun but also easily has problems about structure strength of the spraying gun. Moreover, the conventional spraying gun is also costly in production and thus it loses its market competitiveness due to these complex component parts.

In view of the above circumstances, it is an aspect of the present invention to provide a revolvingly spraying device with fewer component parts and easy for assembly.

Therefore, the present invention provides a revolvingly spraying device comprising: a sheath tube and a revolvingly spraying tube, wherein the sheath tube, which is a hollow tube, is fastened to a spraying device body, the revolvingly spraying tube includes a transmitting tube and a curved tube connected with the transmitting tube, the transmitting tube is inserted within the sheath tube, a front bearing is provided in one end, near the curved tube, of the transmitting tube, and a rear bearing is provided in the other end of the transmitting tube, and the revolvingly spraying tube has a front position limiting portion radially protruding therefrom to retain the front side of the front bearing, and a rear position limiting portion radially protruding therefrom to retain the rear side of the rear bearing.

According to an embodiment of the present invention, a portion of the sheath tube beyond an outer periphery surface of the front bearing and an outer periphery surface of the rear bearing is solid.

According to an embodiment of the present invention, the front position limiting portion is provided at the curved tube.

According to an embodiment of the present invention, the rear position limiting portion is provided at the transmitting tube.

According to an embodiment of the present invention, the sheath tube is provided at an inner periphery surface thereof with a convex portion to space apart between the front bearing and the rear bearing.

According to an embodiment of the present invention, the sheath tube is provided at an inner periphery surface thereof with a front fixing member to retain the front side of the front bearing.

According to an embodiment of the present invention, the transmitting tube is screwed to the curved tube.

According to an embodiment of the present invention, the revolvingly spraying device further comprises an inner tube provided within the revolvingly spraying tube and extending to an end opening of the curved tube through the transmitting tube.

According to an embodiment of the present invention, the revolvingly spraying device further comprises a funneled tube provided at the frond side of the sheath tube and surrounding the curved tube of the revolvingly spraying tube.

According to an embodiment of the present invention, the front bearing and the rear bearing are holding against the sheath tube.

By means of technical means of the present invention, the revolvingly spraying device is assembled with fewer component parts. Most components, each with multiple functions, are formed integrately with each other to achieve the goal of easy manufacture of the revolvingly spraying device and cost saving in production. Nevertheless it still makes the revolvingly spraying device have a stronger structure for stably spraying while being revolved.

BRIEF DESCRIPTION OF THE DRAWINGS

The structure and the technical means adopted by the present invention to achieve the above and other objects can be best understood by referring to the following detailed description of the preferred embodiments and the accompanying drawings.

DETAILED DESCRIPTION OF THE PREFERRED EMBODIMENTS

Figure 1:
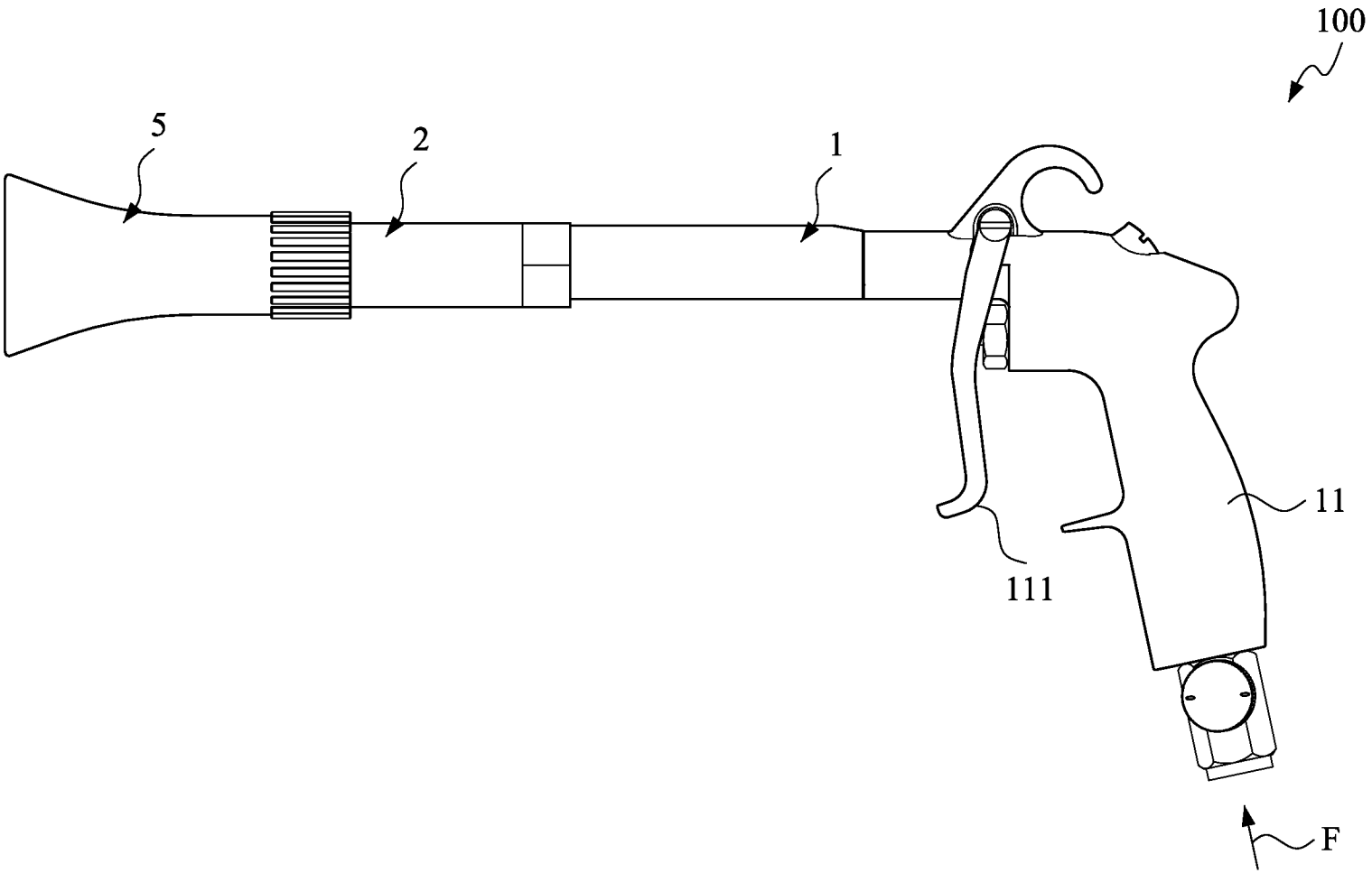
FIG. 1 is a side view of a revolvingly spraying device according to an embodiment of the present invention.
Figure 2:
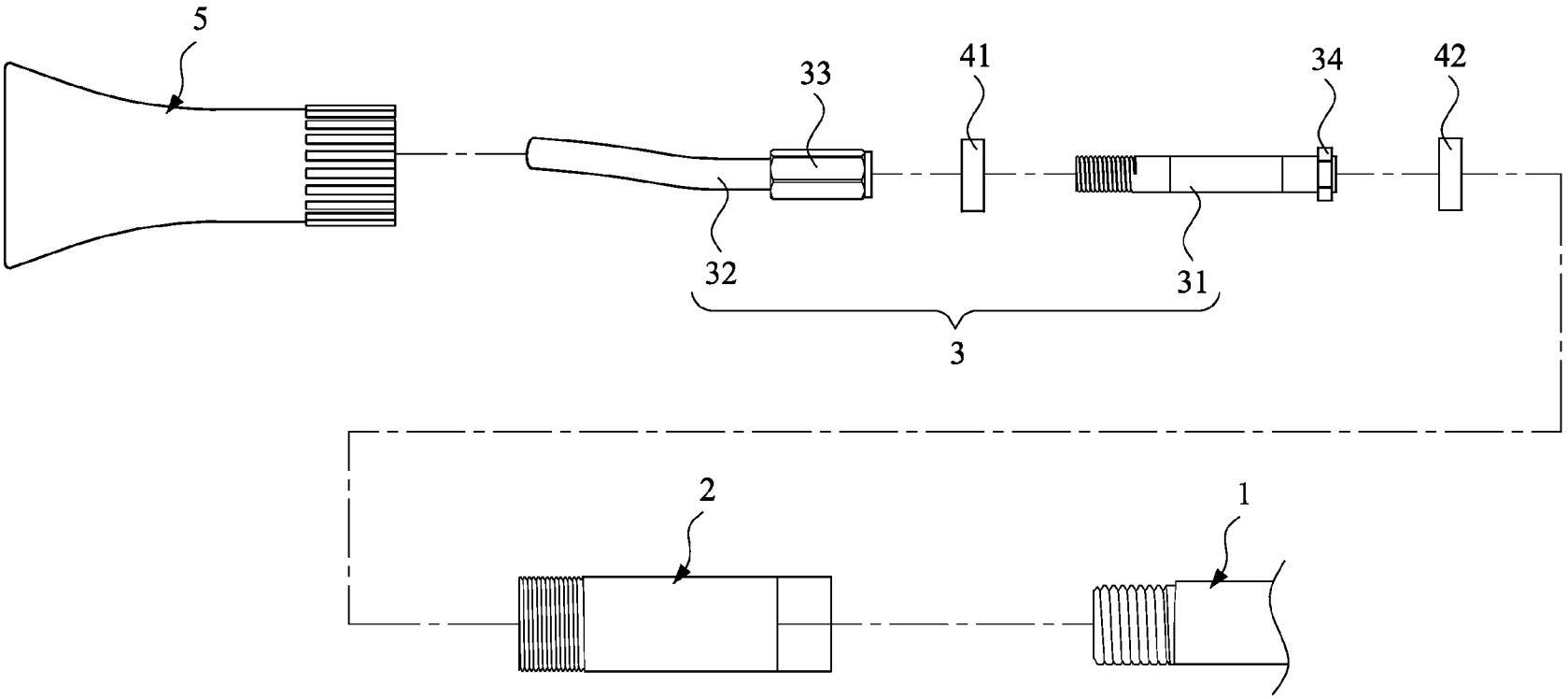
FIG. 2 is a explosion diagram showing the revolvingly spraying device of FIG. 1.
Figure 3:
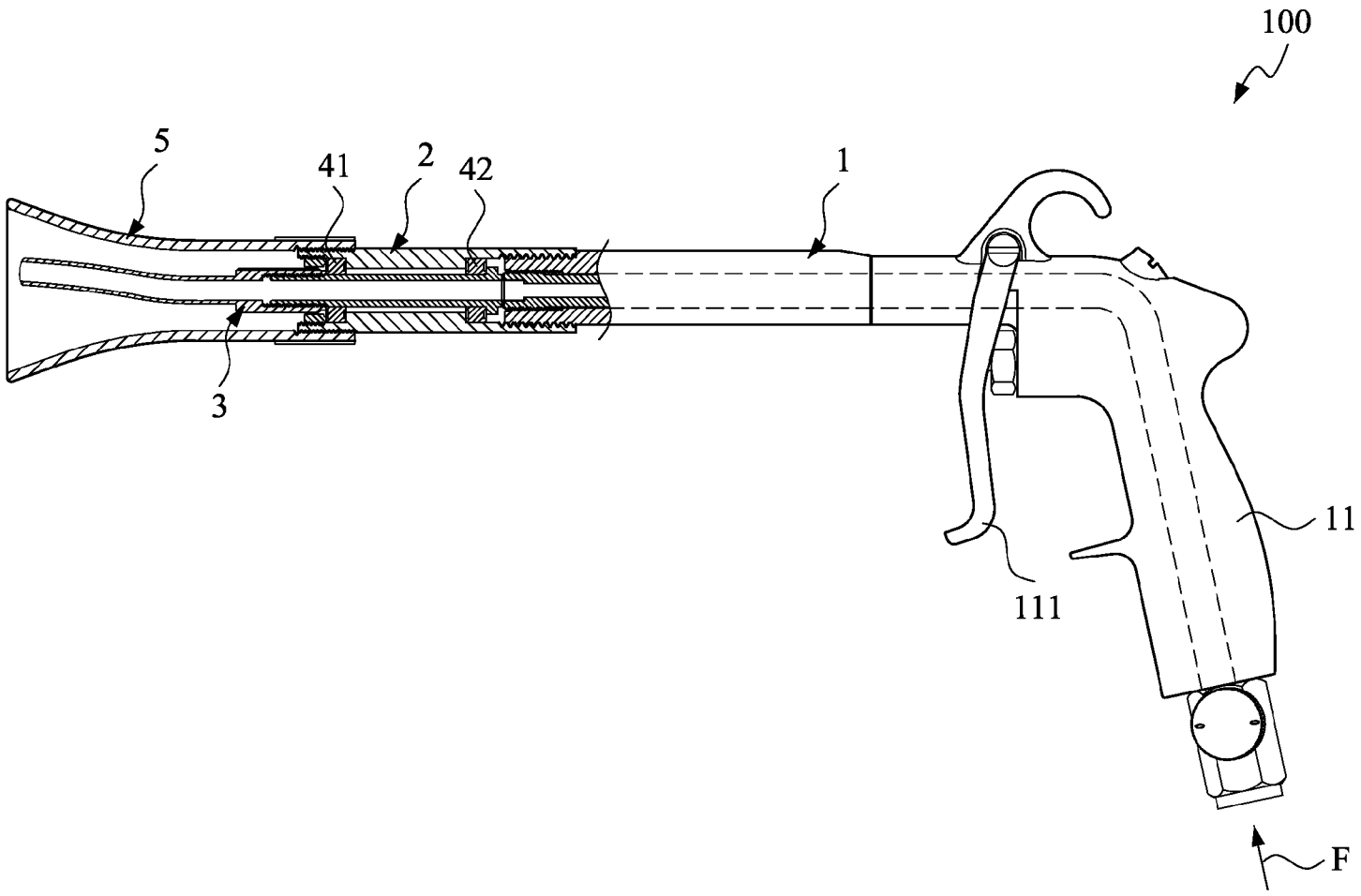
FIG. 3 is a partial cross-section view of the revolvingly spraying device of FIG. 1.
Figure 4:
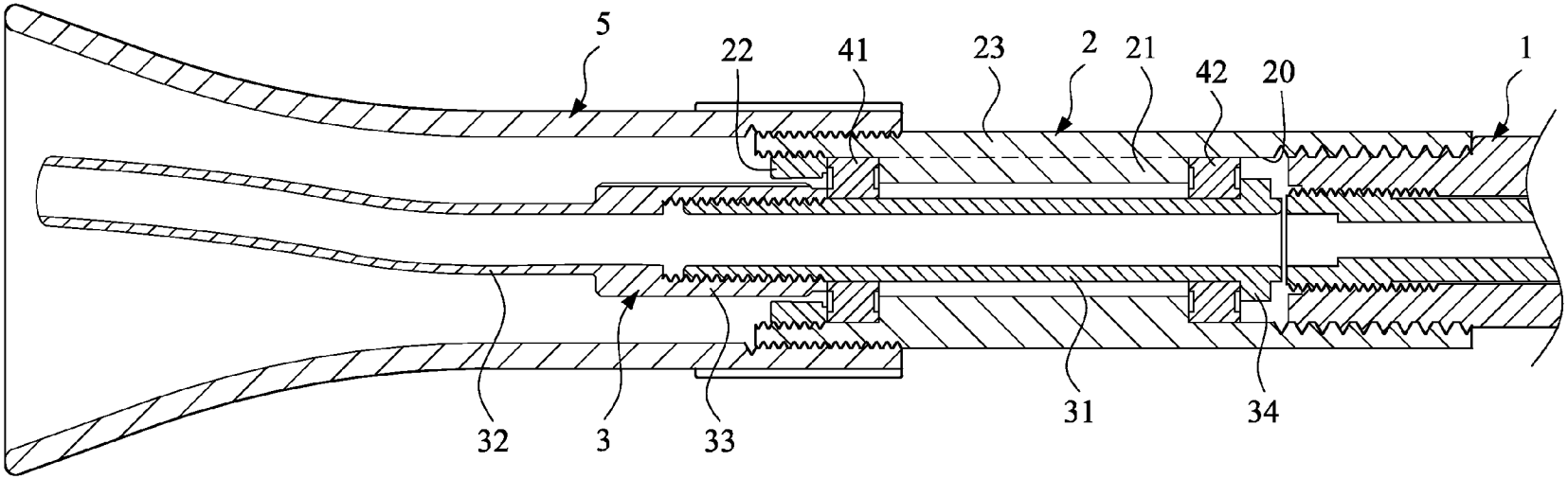
FIG. 4 is a partial enlarged view of the revolvingly spraying device of FIG. 3.

Please refer to FIGS. 1-4. FIG. 1 is a side view of a revolvingly spraying device according to an embodiment of the present invention, FIG. 2 is a explosion diagram showing the revolvingly spraying device of FIG. 1, FIG. 3 is a partial cross-section view of the revolvingly spraying device of FIG. 1, and FIG. 4 is a partial enlarged view of the revolvingly spraying device of FIG. 3.

As shown in FIGS. 1-4, a revolvingly spraying device 100 according to an embodiment of the present invention includes a spraying device body 1, a sheath tube 2, and a revolvingly spraying tube 3.

The spraying device body 1 is used for connecting to a fluid source (not shown) for receiving fluid. In this embodiment, the spraying device body 1 includes a control handle 11 provided with an adjusting means 111. The adjusting means 111, functions as a valve, can be used to adjust the flow rate of a fluid F flowing from the fluid source to the spraying device body 1.

The sheath tube 2, which is a hollow tube, is provided for allowing inserting the revolvingly spraying tube 3 therethrough. One end of the sheath tube 2 is fastened to the spraying device body 1.

The revolvingly spraying tube 3 includes a transmitting tube 31 and a curved tube 32 connected with the transmitting tube 31. In this embodiment, the transmitting tube 31 is screwed to the curved tube 32 for conveniently assembling or separating with each other with rigid fastening structure.

The transmitting tube 31 is inserted within the sheath tube 2. A front bearing 41 is provided at one end, near the curved tube 32, of the transmitting tube 31. And a rear bearing 42 is provided at the other end thereof. Thus, the revolvingly spraying tube 3 can rotate with respect to the sheath tube 2 by the front bearing 41 and the rear bearing 42. Specifically, the transmitting tube 31 is in fluid communication with the spraying device body 1 in such a manner to transmit the fluid F from the spraying device body 1 through the transmitting tube 31 to the curved tube 32 for spraying. The curved tube 32 has an eccentric longitudinal axis, so that the curved tube 32 can be driven by an inclined component force generated by the fluid F passing therethrough. In such a way, the fluid F is sprayed out in every direction after passing through the curved tube 32.

In this embodiment, the front bearing 41 and the rear bearing 42 are holding against an inner periphery surface 20 of the sheath tube 2. However, the front bearing 41 and the rear bearing 42 may be holding against a lateral surface of the sheath tube 2. Alternatively, the front bearing 41 and the rear bearing 42 may be holding against other component of the revolvingly spraying device 100, such as the spraying device body 1.

Preferably, the sheath tube 2 is provided at the inner periphery surface 20 thereof with a convex portion 21 to space apart between the front bearing 41 and the rear bearing 42, so as to prevent the friction between the front bearing 41 and the rear bearing 42. In this embodiment, the convex portion 21 has an annular shape which is convenient for manufacture of assembling with the sheath tube 2. However, the convex portion 21 may have a bump shape or the like. Besides, the sheath tube 2 in this embodiment is further provided at the inner periphery surface 20 thereof with a front fixing member 22 to retain the flat front side of the front bearing 41 at flat peripheral edges of the front side. The front bearing 41 is thus positioned fixedly between the convex portion 21 and the front fixing member 22.

In addition, it is preferred that the portion 23 of the sheath tube 2 beyond the outer periphery surface of the front bearing 41 and the outer periphery surface of the rear bearing 42 is solid. That is, the portion 23 is a compact and solid body without any voids therein. The solid body of the portion 23 has a stronger structure for strongly supporting the revolvingly spraying tube 3, and for more stably rotating the revolvingly spraying tube 3.

The revolvingly spraying tube 3 has a front position limiting portion 33 radially protruding therefrom to retain the front side of the front bearing 41 and be engaged at a flat central area of the front side of the front bearing 41 and a rear position limiting portion 34 radially protruding therefrom to retain the rear side of the rear bearing 42. Therefore, it prevents the revolvingly spraying tube 3 deviating away from the sheath tube 2 by means of limiting the axial movement of the revolvingly spraying tube 3, and it also reduce the undesired displacement and vibration by fixing the front bearing 41 and the rear bearing 42. Preferably, the revolvingly spraying tube 3, position limited by a front position limiting portion 33 and a rear position limiting portion 34, is positioned to form a gap with the spraying device body 1 to prevent the friction therebetween, and thus a smooth revolution of the revolvingly spraying tube 3 can be obtained. Besides, the front position limiting portion 33 and the rear position limiting portion 34 in this embodiment both have an annular shape which is for manufacture as assembling with the revolvingly spraying tube 3. However, the front position limiting portion 33 and the rear position limiting portion 34 may have a bump shape or the like as long as they have function of retaining the front bearing 41 and the rear bearing 42.

In this embodiment, the front position limiting portion 33 is provided at the curved tube 32, and the rear position limiting portion 34 is provided at the transmitting tube 31. In such structure, it is convenient to allocate the front position limiting portion 33 and the rear position limiting portion 34 to the position that retains the front bearing 41 and the rear bearing 42 by means of assembling the curved tube 32 with the transmitting tube 31. Besides, the front position limiting portion 33 is formed integrately with the curved tube 32, and the rear position limiting portion 34 is formed integrately with the transmitting tube 31. Therefore, the front position limiting portion 33 and the curved tube 32 is manufactured as a single part and the rear position limiting portion 34 and the transmitting tube 31 are manufactured as another single part. Thus, it can reduce the number of components, save time for producing, and prevent the front position limiting portion 33 and the rear position limiting portion 34 deviating away from the transmitting tube 31 and the curved tube 32 respectively.

The revolvingly spraying device 100 further include a funneled tube 5 provided at the frond side of the sheath tube 2 and surrounding the curved tube 32 of the revolvingly spraying tube 3 to prevent the revolvingly spraying tube 3 from damage. The funneled tube 5 also can be used for gathering the fluid F spraying from the revolvingly spraying tube 3 to improve cleaning efficiency.

Figure 5:
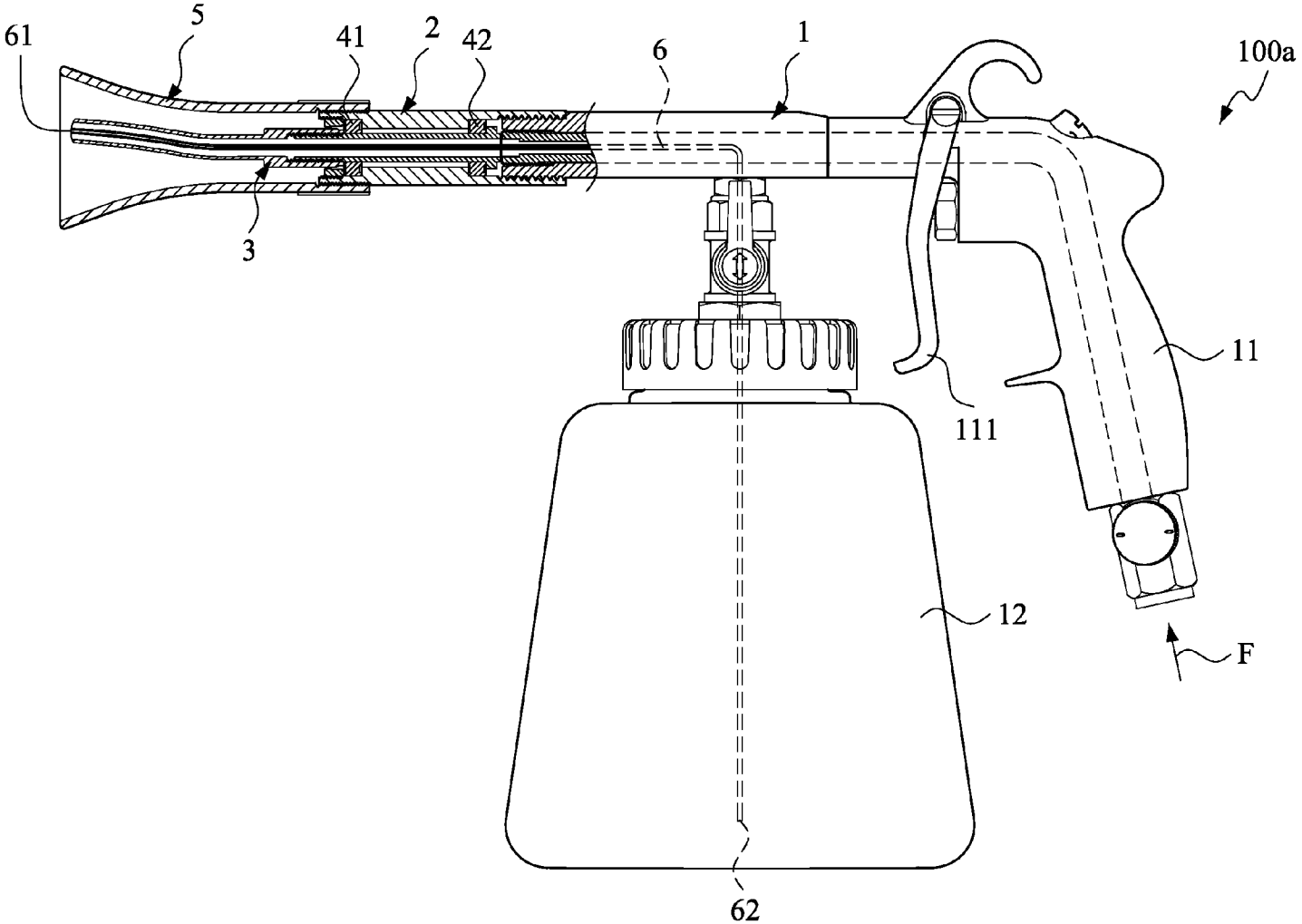
FIG. 5 is a partial cross-section view of a revolvingly spraying device according to another embodiment of the present invention.

Please refer to FIG. 5, which is a partial cross-section view of a revolvingly spraying device according to another embodiment of the present invention. The elements of a revolvingly spraying device 100*a* in this embodiment are similar to those in the embodiment described above. The same elements in this embodiment are labeled with the same reference numbers as those in the embodiment described above. It is characterized in that the revolvingly spraying device 100*a* in this embodiment further includes an inner tube 6. The inner tube 6 is provided with an output end 61 disposed within the revolvingly spraying tube 3 and being extended to an end opening of the curved tube 32 through the transmitting tube 31. An input end 62 of the inner tube 6 is provided extending to a water supplying means 12 through the spraying device body 1.

With above structure, Venturi effect is induced at the end opening of the curved tube 32 when the fluid F flows through the revolvingly spraying tube 3. This effect makes water contained in the water supplying means 12 being sucked into the inner tube 6 and then outputting from the output end 61 of the inner tube 6. After that, water will be mixed with the fluid F and be sprayed outside through the curved tube 32.

As can be appreciated from the above embodiments, the revolvingly spraying device of the present invention has industry worth which meets the requirement for a patent. The above description should be considered as only the discussion of the preferred embodiments of the present invention. However, a person having ordinary skill in the art may make various modifications to the present invention. Those modifications still fall within the spirit and scope defined by the appended claims.

What is claimed is:

1. A revolvingly spraying device comprising:

a sheath tube; and a revolvingly spraying tube;

wherein the sheath tube, which is a hollow tube, is fastened to a spraying device body, the revolvingly spraying tube comprises a transmitting tube and a curved tube connected with the transmitting tube, the transmitting tube is inserted within the sheath tube, a front bearing is provided in one end, near the curved tube, of the transmitting tube, and a rear bearing is provided in the other end of the transmitting tube;

the revolvingly spraying tube has a front position limiting portion radially protruding therefrom to retain a flat front side of the front bearing and to be engaged at a flat central area of the front side, and a rear position limiting portion radially protruding therefrom to retain the rear side of the rear bearing;

the sheath tube is provided at an inner periphery surface thereof with a front fixing member to retain the front side of the front bearing at flat peripheral edges of the front side, the front fixing member and the front position limiting portion cooperatively retain at the front side of the front bearing to fix the front bearing in position, and engaging between the front fixing member and the front side of the front bearing is entirely coplanar with engaging between the front position limiting portion and the front side of the front bearing due to the front side of the front bearing being flat; and the front position limiting portion is provided at the curved tube.

2. The revolvingly spraying device as claimed in claim 1, wherein a portion of the sheath tube beyond an outer periphery surface of the front bearing and an outer periphery surface of the rear bearing is solid.

3. The revolvingly spraying device as claimed in claim 1, wherein the rear position limiting portion is provided at the transmitting tube.

4. The revolvingly spraying device as claimed in claim 1, wherein the sheath tube is provided at an inner periphery surface thereof with a convex portion to space apart between the front bearing and the rear bearing.

5. The revolvingly spraying device as claimed in claim 1, wherein the transmitting tube is screwed to the curved tube.

6. The revolvingly spraying device as claimed in claim 1, further comprising an inner tube provided within the revolvingly spraying tube and extending to an end opening of the curved tube through the transmitting tube.

7. The revolvingly spraying device as claimed in claim 1, further comprising a funneled tube provided at the front side of the sheath tube and surrounding the curved tube of the revolvingly spraying tube.

8. The revolvingly spraying device as claimed in claim 1, wherein the front bearing and the rear bearing are holding against the sheath tube.

9. The revolvingly spraying device as claimed in claim 1, wherein the revolvingly spraying tube is positioned and limited by the front position limiting portion and a rear position limiting portion to form a gap with the spraying device body for preventing friction therebetween.

10. A revolvingly spraying device comprising:

a sheath tube; and a revolvingly spraying tube;

wherein the sheath tube, which is a hollow tube, is fastened to a spraying device body, the revolvingly spraying tube comprises a transmitting tube and a curved tube connected with the transmitting tube, the transmitting tube is inserted within the sheath tube, a front bearing is provided in one end, near the curved tube, of the transmitting tube, and a rear bearing is provided in the other end of the transmitting tube;

the revolvingly spraying tube has a front position limiting portion radially protruding therefrom to retain a flat front side of the front bearing and to be engaged at a flat central area of the front side, and a rear position limiting portion radially protruding therefrom to retain the rear side of the rear bearing;

the sheath tube is provided at an inner periphery surface thereof with a front fixing member to retain the front side of the front bearing at flat peripheral edges of the front side, the front fixing member and the front position limiting portion cooperatively retain at the front side of the front bearing to fix the front bearing in position, and engaging between the front fixing member and the front side of the front bearing is entirely coplanar with engaging between the front position limiting portion and the front side of the front bearing due to the front side of the front bearing being flat; and the rear position limiting portion is provided at the transmitting tube.

11. A revolvingly spraying device comprising:

a sheath tube; and a revolvingly spraying tube;

wherein the sheath tube, which is a hollow tube, is fastened to a spraying device body, the revolvingly spraying tube comprises a transmitting tube and a curved tube connected with the transmitting tube, the transmitting tube is inserted within the sheath tube, a front bearing is provided in one end, near the curved tube, of the transmitting tube, and a rear bearing is provided in the other end of the transmitting tube;

the revolvingly spraying tube has a front position limiting portion radially protruding therefrom to retain a flat front side of the front bearing and to be engaged at a flat central area of the front side, and a rear position limiting portion radially protruding therefrom to retain the rear side of the rear bearing;

the sheath tube is provided at an inner periphery surface thereof with a front fixing member to retain the front side of the front bearing at flat peripheral edges of the front side, the front fixing member and the front position limiting portion cooperatively retain at the front side of the front bearing to fix the front bearing in position, and engaging between the front fixing member and the front side of the front bearing is entirely coplanar with engaging between the front position limiting portion and the front side of the front bearing due to the front side of the front bearing being flat; and the transmitting tube is screwed to the curved tube.

* * * * *